US008874006B2

(12) United States Patent
Nelson et al.

(10) Patent No.: US 8,874,006 B2
(45) Date of Patent: Oct. 28, 2014

(54) LIQUID MARKING AGENT DEVELOPMENT ASSEMBLIES, HARD IMAGING DEVICES, AND LIQUID MARKING AGENT HARD IMAGING METHODS

(75) Inventors: Eric G. Nelson, San Diego, CA (US); Thomas Anthony, Sunnyvale, CA (US); David Sabo, San Diego, CA (US); Derek Patton, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 186 days.

(21) Appl. No.: 13/259,096

(22) PCT Filed: Aug. 31, 2009

(86) PCT No.: PCT/US2009/055551

§ 371 (c)(1), (2), (4) Date: Sep. 22, 2011

(87) PCT Pub. No.: WO2011/025508

PCT Pub. Date: Mar. 3, 2011

(65) Prior Publication Data

US 2012/0148310 A1 Jun. 14, 2012

(51) Int. Cl.
*G03G 15/10* (2006.01)

(52) U.S. Cl.
CPC ..... *G03G 15/104* (2013.01)
USPC ..... 399/241; 399/239; 399/249

(58) Field of Classification Search
USPC ..... 399/233, 237–239, 241, 249
See application file for complete search history.

(56) References Cited

U.S. PATENT DOCUMENTS

| | | | | |
|---|---|---|---|---|
| 5,519,473 | A | 5/1996 | Morehouse, Jr. et al. | |
| 5,557,376 | A | 9/1996 | Landa et al. | |
| 8,428,495 | B2 * | 4/2013 | Li | 399/237 |
| 8,437,649 | B2 * | 5/2013 | Ochi et al. | 399/237 |
| 2003/0231903 | A1 * | 12/2003 | Kim | 399/237 |
| 2005/0158082 | A1 * | 7/2005 | Shin et al. | 399/237 |
| 2005/0238971 | A1 | 10/2005 | Jodra et al. | |
| 2006/0153596 | A1 * | 7/2006 | Gilan et al. | 399/237 |
| 2006/0153597 | A1 * | 7/2006 | Guzman et al. | 399/237 |
| 2007/0231013 | A1 * | 10/2007 | Hasdai et al. | 399/241 |
| 2009/0148190 | A1 * | 6/2009 | Nelson et al. | 399/249 |
| 2012/0148311 | A1 * | 6/2012 | Nelson et al. | 399/237 |

FOREIGN PATENT DOCUMENTS

| | | | |
|---|---|---|---|
| JP | 07-311503 | A | 11/1995 |
| KR | 10-0644685 | B1 | 11/2006 |

OTHER PUBLICATIONS

International Search Report and Written Opinion Dated May 18, 2010 issued on PCT Application No. PCT/US2009/055551, filed on Aug. 31, 2009, 10 pages.

* cited by examiner

*Primary Examiner* — Susan Lee

(57) ABSTRACT

Liquid marking agent development assemblies, hard imaging devices, and liquid marking agent hard imaging methods are described. According to one aspect, a liquid marking agent development assembly includes a developer member having an outer surface, a marking agent delivery system to supply a liquid marking agent comprising a plurality of ink particles to a first location of the outer surface of the developer member, and a development system to adhere a plurality of the ink particles to the outer surface of the developer member, and wherein the development system is to adhere the adhered ink particles at a second location of the outer surface of the developer member which is upstream from the first location with respect to a direction of movement of the outer surface of the developer member.

15 Claims, 4 Drawing Sheets

LIQUID MARKING AGENT DEVELOPMENT ASSEMBLIES, HARD IMAGING DEVICES, AND LIQUID MARKING AGENT HARD IMAGING METHODS

BACKGROUND OF THE DISCLOSURE

Imaging devices capable of printing images upon paper and other media are ubiquitous and used in many applications including monochrome and color applications. For example, laser printers, ink jet printers, and digital printing presses are but a few examples of imaging devices in wide use today for monochrome or color imaging.

Electrophotographic imaging processes utilize a photoconductor which may be electrically charged and then selectively discharged to form latent images. The latent images may be developed and the developed images are transferred to media to form hard images upon the media. Electrophotographic imaging processes may be implemented in laser printer configurations and digital presses in illustrative examples.

Some imaging devices use a liquid marking agent to develop images. In some arrangements, it may be desirable to modify components and designs to allow increased variance in components. Also, the components may be increased in size to provide imaging upon larger media increasing throughput of the devices. However, relaxing design tolerances of components and/or increasing size of components, may present issues in systems which use liquid marking agents.

At least some aspects of the disclosure provide improved imaging structures and methods.

DETAILED DESCRIPTION

According to some embodiments of the disclosure, hard imaging devices, development assemblies and hard imaging methods utilize a marking agent to develop and form hard images upon media. An example marking agent which may be used during imaging is a liquid marking agent. In one example of reducing design tolerances, a size of a gap in a development assembly of a hard imaging device may be increased to reduce the requirements of design tolerances upon the components adjacent to the gap, and the increased gap may change flow of the liquid marking agent within the device during imaging. As described in detail below, some embodiments of the disclosure cause liquid marking agent to flow against a direction of movement of a developer member. In a more specific example described in detail below, a majority of the development of the liquid marking agent upon the developer member may occur at a location of the developer member which is upstream from another location where the liquid marking agent is introduced to the developer member. Other embodiments are described in the disclosure below.

One example of a liquid marking agent which may be used during imaging operations comprises ink particles (e.g., cyan, magenta, yellow or black particles in one example) suspended in a liquid carrier fluid, such as oil (e.g., Isopar-L available from the ExxonMobil Corporation). One suitable liquid marking agent is Electroink® available from the Hewlett-Packard Company.

During example development operations using a liquid marking agent, the ink particle concentration of the liquid marking agent is increased by several times in a development assembly and the ink particles are applied to an imaging member to develop latent images formed thereon and at least a substantial portion of the liquid carrier is removed or evaporates prior to transfer of the ink particles to media.

Figure 1:
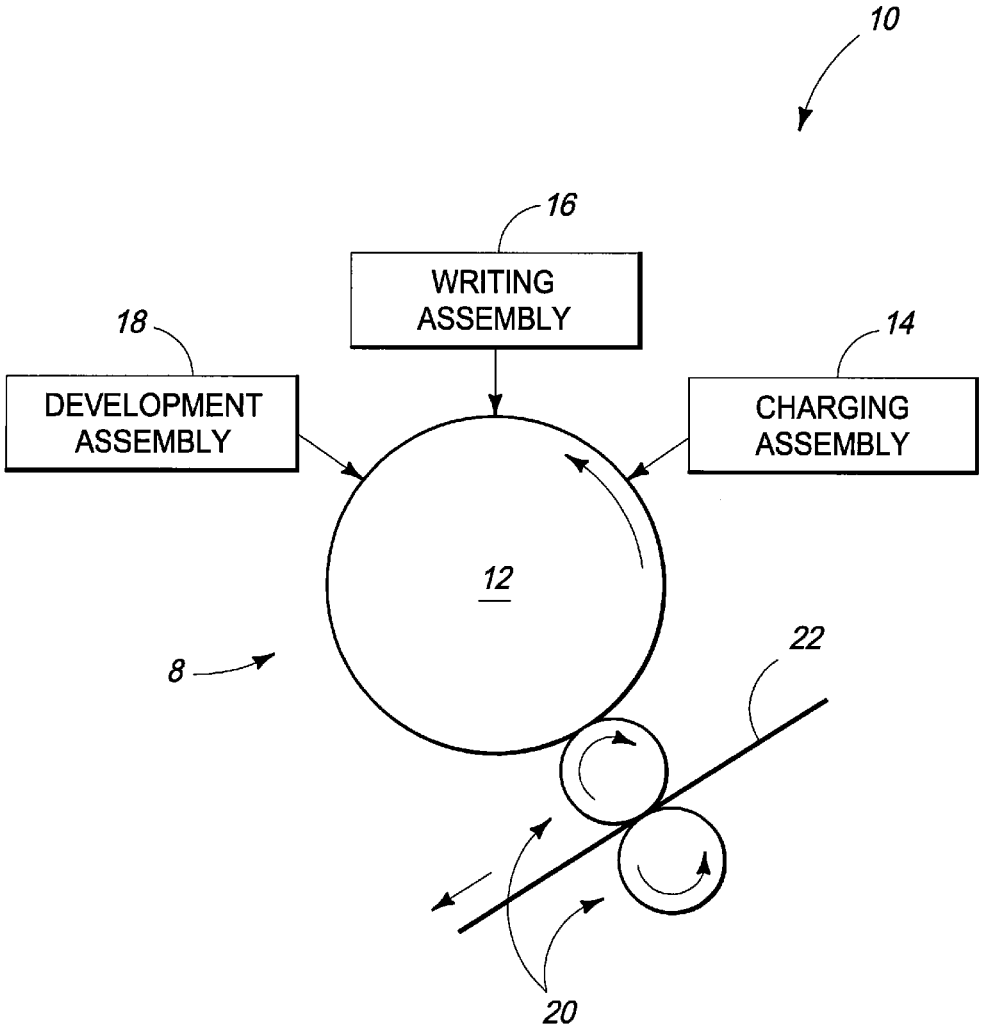
FIG. 1 is an illustrative representation of a hard imaging device according to one embodiment.

Referring to FIG. 1, an example of an image engine 8 of a hard image device 10 is shown according to one illustrative embodiment. The depicted arrangement of the hard imaging device 10 is configured to implement electrophotographic imaging wherein latent images are formed and developed by the image engine 8 to form developed images which are subsequently transferred to media 22 to form hard images. Examples of hard imaging devices 10 include digital presses (e.g. Indigo®, presses available from the Hewlett-Packard Company) which utilize a liquid marking agent although other configurations of devices 10 may be used.

The image engine 8 of hard imaging device 10 depicted in FIG. 1 includes an imaging member 12, a charging assembly 14, a writing assembly 16, a development assembly 18, and a transfer assembly 20. Hard imaging device 10 is configured to form hard images upon media 22, such as paper or other suitable imaging substrates. Other hard imaging devices 10 may include more, less or alternative components or other arrangements in other embodiments.

In one operational embodiment, charging assembly 14 is configured to deposit a blanket electrical charge upon substantially an entirety of an outer surface of imaging member 12 which may be implemented as a photoconductor, such as a photo imaging plate, photoconductive belt or drum configured to move in the same direction (i.e., with) a developer member described below of development assembly 18.

Writing assembly 16 is configured as a laser in one embodiment to discharge selected portions of the outer surface of the imaging member 12 to form latent images.

Development assembly 18 may be referred to as a binary ink developer (BID) in one embodiment which is configured to provide a layer of ink particles of the marking agent to the outer surface of imaging member 12 to develop the latent images formed thereon. Ink particles of the liquid marking agent may be electrically charged to the same electrical polarity as the blanket charge provided to the outer surface of the imaging member 12 and attracted to and received by the discharged portions of the outer surface of the imaging member 12 corresponding to the latent images to develop the latent images and providing developed images in one embodiment. The developed images are transferred by transfer assembly 20 from the outer surface of the imaging member 12 to media 22. Portions of the layer of the ink particles provided by the development assembly 18 and which correspond to non-discharged (i.e., background) portions of the imaging member 12 are not transferred to the imaging member 12 and may be subsequently cleaned as described below.

Figure 2:
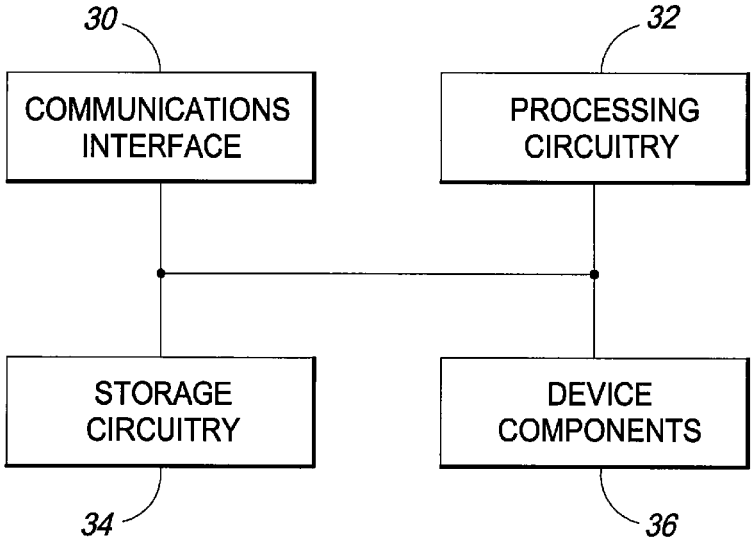
FIG. 2 is a functional block diagram of circuit components of a hard imaging device according to one embodiment.

Referring to FIG. 2, an example of circuit components of hard imaging device 10 is illustrated according to one embodiment. The circuit components include a communications interface 30, processing circuitry 32, storage circuitry 34 and device components 36 in one embodiment of hard imaging device 10. More, less or alternative components are provided in other embodiments of hard imaging device 10.

Communications interface 30 is arranged to implement communications of hard imaging device 10 with respect to external devices (not shown). For example, communications interface 30 may be arranged to communicate information bi-directionally with respect to device 10. Communications interface 12 may be implemented as a network interface card (NIC), serial or parallel connection. USB port, Firewire interface, flash memory interface, floppy disk drive, or any other suitable arrangement for communicating with respect to device 10. In one example, image data of hard images to be formed may be received by communications interface 30 from an external network or external source (e.g., computer).

In one embodiment, processing circuitry 32 is arranged to process data, control data access and storage, issue commands, and control imaging operations of device 10. Processing circuitry 32 is configured to control imaging operations of device 10, such as the formation and development of latent images upon imaging member 12 in one embodiment.

Processing circuitry 32 may comprise circuitry configured to implement desired programming provided by appropriate media in at least one embodiment. For example, the processing circuitry 32 may be implemented as one or more of a processor and/or other structure configured to execute executable instructions including, for example, software and/or firmware instructions, and/or hardware circuitry. Exemplary embodiments of processing circuitry 32 include hardware logic, PGA, FPGA, ASIC, state machines, and/or other structures alone or in combination with a processor. These examples of processing circuitry 32 are for illustration and other configurations are possible.

The storage circuitry 34 is configured to store programming such as executable code or instructions (e.g., software and/or firmware), electronic data, databases, image data, or other digital information and may include processor-usable media. Processor-usable media may be embodied in any computer program product(s) or article of manufacture(s) which can contain, store, or maintain programming, data and/or digital information for use by or in connection with an instruction execution system including processing circuitry in the exemplary embodiment. For example, exemplary processor-usable media may include any one of physical media such as electronic, magnetic, optical, electromagnetic, infrared or semiconductor media. Some more specific examples of processor-usable media include, but are not limited to, a portable magnetic computer diskette, such as a floppy diskette, zip disk, hard drive, random access memory, read only memory, flash memory, cache memory, and/or other configurations capable of storing programming, data, or other digital information.

At least some embodiments or aspects described herein may be implemented using programming stored within appropriate storage circuitry 34 described above and configured to control appropriate processing circuitry 32. For example, programming may be provided via appropriate articles of manufacture including, for example, embodied within media discussed above.

Device components 36 include additional electrical components of the hard imaging device 10. For example, device components 36 may include sensors, pumps, motors, a user interface, variable valves, and other additional electrical or electro-mechanical components which may be controlled or monitored by processing circuitry 32.

Figure 3:
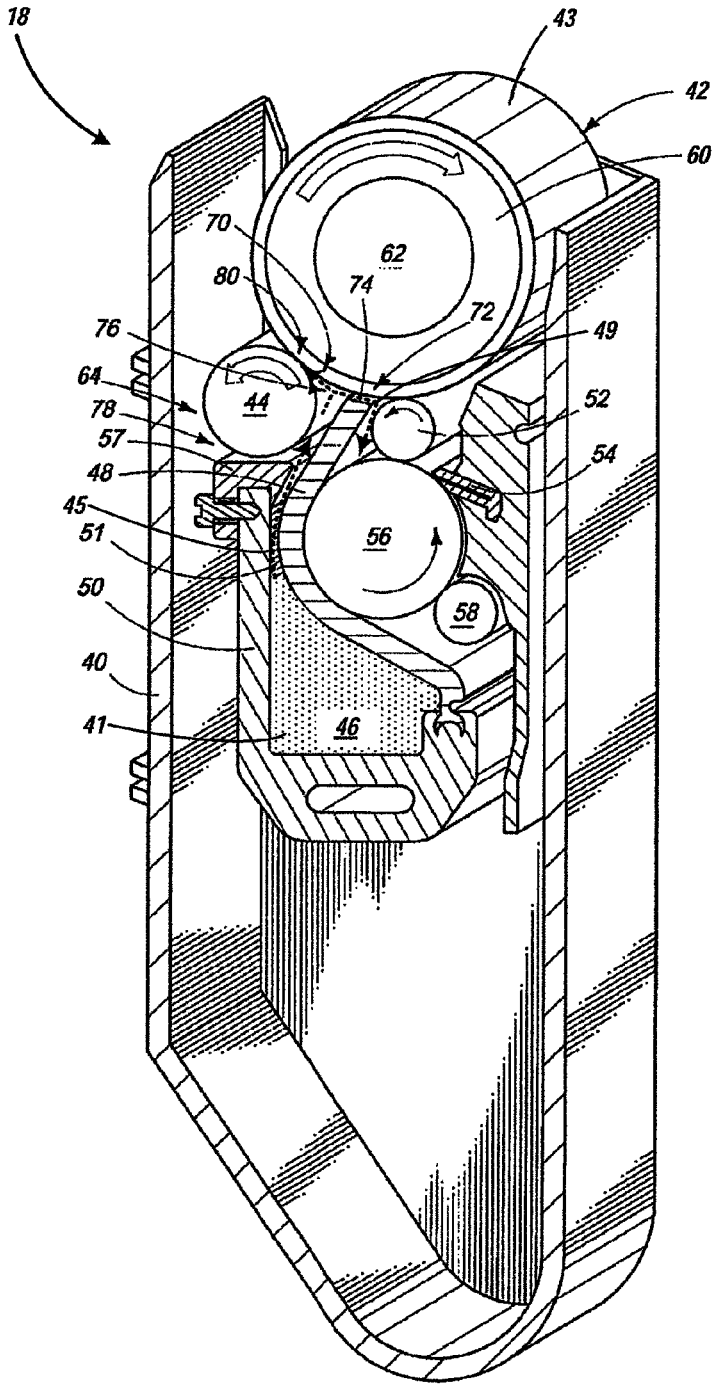
FIG. 3 is an isometric view of a development assembly of a hard imaging device according to one embodiment.
Figure 4:
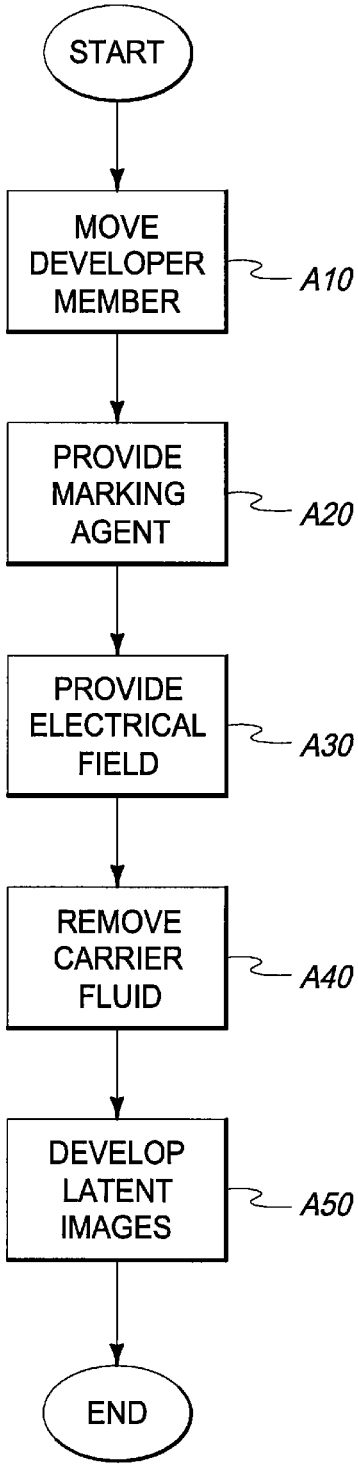
FIG. 4 is a flow chart of a method of hard imaging method according to one embodiment.

Referring to FIG. 3, details of one embodiment of development assembly 18 are shown. A single arrangement of development assembly 18 of FIG. 3 may be used for monochrome hard imaging devices 10 in one embodiment. In addition, a plurality of the arrangements of assemblies 18 of FIG. 3 may be used for different colors of color hard imaging devices 10 in one embodiment. In one example (e.g., including a plurality of development assemblies 18 for respective separations), the assemblies 18 may be spaced from imaging member 12 when the assemblies are not developing latent images and may be individually moved to a development position such that the development assembly 18 provides the appropriate color marking agent to the imaging member 12 at an appropriate moment in time to develop latent images on the imaging member 12.

In one embodiment, the example development assembly 18 includes a tray 40 which partially houses a developer member 42, such as a roller, and other components. Although not shown in FIG. 3, imaging member 12 is provided adjacent to developer member 42 and an outer surface 43 of developer member 42 is configured to move (e.g., rotate) to provide a layer of marking agent to a rotating outer surface of the imaging member 12 to develop latent images formed upon the outer surface of the imaging member 12. Some of the ink particles of the layer of the liquid marking agent upon the developer member 42 develop latent images formed upon the outer surface of the imaging member 12 to form developed images which may be subsequently transferred to media. In one embodiment, developer member 42 includes a conductive polyurethane outer layer 60 provided about a metal core 62. Ink particles which correspond to background portions are not transferred to imaging member 12 in one embodiment.

During imaging operations, a liquid marking agent 41 may be introduced from a reservoir (not shown) into development assembly 18 at an internal chamber 46. The liquid marking agent may be pumped into chamber 46 of a marking agent delivery system (which may also include the respective pump—not shown) at a rate of approximately 10 l/min in one embodiment. Chamber 46 is defined by an electrically conductive electrode 48 (also referred to as a back electrode) and chamber wall members 50, 57 (which may be electrically insulative in one embodiment). The chamber 46 is sealed by walls at the front and rear sides (not shown) to form a substantially enclosed chamber 46 with an outlet to chamber 51. The received marking agent 41 flows upwards through chamber 51 to the surface 43 of developer member 42 and a development system 64, as shown by the dashed arrow 45.

Development system 64 is configured to implement development operations upon surface 43 including forming a layer of solids (e.g., ink particles) from the liquid marking agent upon the outer surface 43 of developer member 42. In one embodiment, development system 64 is configured to adhere a plurality of the ink particles to the outer surface 43 of the developer member 42 to develop the layer of ink particles upon surface 43 of developer member 42.

In the depicted example embodiment, development system 64 includes a squeegee 44 and an electrode 48 configured to develop a layer of ink particles of the liquid marking agent upon surface 43 of developer member 42. In one embodiment, liquid marking agent 41 is supplied from reservoir 46 and chamber 51 of the marking agent delivery system to a first location 70 of the outer surface 43 of developer member 42. Squeegee 44 is in contact with outer surface 43 of developer member 42 in the illustrated example embodiment. Further, the liquid marking agent 41 is under pressure from a pump of the marking agent delivery system in one embodiment and at least a majority of the liquid marking agent is forced to flow towards electrode 48 and against (i.e., in a direction opposite to) a direction of movement of developer member 42, as shown by the dashed arrow 49.

The liquid marking agent 41 passes through a gap 76 between the electrode 48 and a second location 72 of outer surface 43 of developer member 42, as shown by the dashed arrow 49. A surface 74 of electrode 48 opposes the outer surface 43 of developer member 42 at second location 72. Squeegee 44 is positioned at a third location 80 of the outer surface 43 of the developer member 42 which is downstream of both of the first and second locations 70, 72 with respect to a direction of movement of surface 43 of developer member 42

In the described embodiment, the first, second and third locations 70, 72, 80 refer to fixed positions in space of the outer surface 43 of the developer member 42, and accordingly, different portions of the outer surface 43 are positioned at the first, second and third locations 70, 72, 80 at different moments in time as the developer member 42 rotates during imaging operations. As shown in the depicted example, second location 72 is positioned upstream from first and third locations 70, 80 with respect to a direction of movement of the developer member 42.

Various components of the development assembly 18 are biased at different voltages in the described embodiment to implement development operations to develop a layer of ink particles of liquid marking agent upon outer surface 43 of developer member 42. In one embodiment, the ink particles of the liquid marking agent become negatively-charged and components of the development assembly 18 are biased to cause the negatively-charged ink particles to be attracted to and adhere to the outer surface 43 of developer member 42 to form a layer of ink particles of the liquid marking agent thereon.

In one embodiment, components of the development system 64 generate an electrical field relative to the developer member 42 to develop (i.e., form) a substantially uniform layer of the ink particles upon the surface 43 of the developer member 42. For example, in some liquid marking agents, charge director molecules may be initially attached to ink particles of the liquid marking agent. The charge directors include both positive and negative ions. However, in one embodiment, as the marking agent passes through channel 51 and gap 76, the liquid marking agent is subject to an electrical field from the electrode 48 relative to the developer member 42 due to biasing of such components as described further below. The generated electrical field operates to strip away the positive ions of the charge directors leaving the ink particles negatively charged. The generated electrical field also operates to direct the negatively-charged ink particles to surface 43 of developer member 42 to develop the layer of ink particles upon outer surface 43 in one embodiment.

As mentioned above, the liquid marking agent introduced at first location 70 of surface 43 flows towards second location 72 and some or substantially all of the liquid marking agent flows through gap 76. Surface 74 of electrode 48 may be spaced different distances from surface 43 of member 42 in different embodiments. In example configurations, gap 76 may be within a range of 0.5-1.0 mm.

The size of gap 76 may be based upon a number of factors including whether or not a gap 78 exists intermediate squeegee 44 and chamber wall member 57 (and the size of gap 78 if provided), and whether a gap exists at the nip formed by developer member 42 and squeegee 44 (e.g., squeegee 44 contacts surface 43 of developer member 42 in one embodiment).

Furthermore, the size of gap 76 may be freely adjusted since the gap size is decoupled from the flow rate of the liquid marking agent (i.e., the amount of flow of the liquid marking agent is not dependent upon the size of gap 76) in one embodiment. More specifically, in the described embodiment, gap 76 at the second location is upstream from the first location 70 with respect to the direction of movement of the developer member 42 and the movement of the developer member 42 urges the liquid marking agent at location 70 towards squeegee 44 which decouples a flow rate of supplied liquid marking agent from the size of gap 76. In addition, despite the rotation of developer member 42, the pressure of the liquid marking agent causes the liquid marking agent to flow through gap 76. In one embodiment, substantially an entirety of chamber 51 and regions adjacent to the first location 70 defined by surface 43, squeegee 44, and electrode 48 are filed with liquid marking agent during imaging operations.

Different biasing voltages may be used depending upon the configuration of components of the development assembly 18. In one illustrative example, the developer member 42 is biased at −500 VDC. If gap 76 is 0.5 mm, electrode 48 may be biased at −2000 VDC in one embodiment. If gap 76 is 1.0 mm, electrode 48 may be biased at −4000 VDC in one embodiment. This biasing of electrode 48 causes development of a layer of ink particles of the liquid marking agent upon outer surface 43 at the second location 72. Carrier fluid and undeveloped ink particles flow through the gap 76 towards cleaner roller 52 for recycling.

An amount of biasing of electrode 48 may also be affected by a length of surface 74 of electrode 48 adjacent to surface 43 of developer member 42 and a speed of movement of surface 43.

In one embodiment. Chamber wall member 50 may be electrically conductive. Furthermore, chamber wall member 50 may also be biased the same as electrode 48 to reduce or avoid development of ink particles of the liquid marking agent upon the electrode 48 or member 50.

Furthermore, in one example embodiment, chamber wall member 57 may also be electrically conductive and biased the same as member 50 and electrode 48. This example configuration may result in development of ink particles upon squeegee 44 since members 50, 57 are biased at an increased negative voltage compared with the biasing of squeegee 44 (i.e., the members 50, 57 are more negatively biased than squeegee 44). The ink particles developed upon squeegee 44 in the presently described example embodiment may be passed to surface 43 assisting with development of the layer of ink particles upon developer member 42 and also permitting voltages of smaller delta biasing voltages to be used relative to the developer member 42 which may result in reduced defects.

Squeegee 44 may be biased at −900 VDC in one embodiment to provide some development of ink particles upon outer surface 43. In one embodiment, the majority of the development of the ink particles upon surface 43 occurs at gap 76 and squeegee 44 provides some development of the ink particles (less than the development at gap 76) and squeegee 44 also operates to compact the developed layer of ink particles upon surface 43 and dry the layer of ink particles by removing at least some of the carrier fluid. In one arrangement, approximately 90% of the development of the layer of ink particles of the liquid marking agent upon surface 43 occurs at gap 76 and 10% occurs at the nip of squeegee 44 and developer member 42. In some arrangements, squeegee 44 may be biased such that relatively no development occurs at the nip of squeegee 44 and surface 43 and substantially an entirety of the development of the layer of ink particles occurs at gap 76. The biasing of squeegee 44 and electrode 48 may be varied in other embodiments to control or tune aspects of the developed layer of ink particles upon surface 43 (e.g., different biasing voltages may be used to control the thickness of the developed layer of ink particles upon surface 43 in one embodiment).

Cleaner roller 52 may be biased at approximately −150 VDC in one embodiment to attract and clean ink particles of the liquid marking agent from surface 43 in one arrangement. For example, cleaner roller 52 may remove ink particles from surface 43 which were not transferred to the imaging member 12.

As described above, a defined gap 78 may be present between chamber wall member 57 and squeegee 44 in some embodiments. The presence of gap 78 may result in some liquid marking agent being expelled and flowing through gap 78 which operates to reduce or eliminate air from being sucked through gap 78 into the liquid marking agent used to develop surface 43 and which may otherwise cause flow streaks degrading print quality. Gap 78 is selected in one implementation to be smaller than gap 76. For example, gap 78 may be 0.2-0.5 mm if gap 76 is 0.5-1.0 mm. In a more specific example, gap 78 may be 0.3-0.4 mm if gap 76 is 0.7-0.8 mm. Gap 78 may be sized to be substantially the same as gap 76 (e.g., 0.5 mm) if members 50, 57 are conductive and biased in one embodiment discussed above. No gap is provided intermediate chamber wall member 57 and squeegee 44 in at least one configuration.

It is desired in some embodiments to achieve appropriate optical density (e.g., 1.4 in but one example) on printed media 22 which is accomplished in one embodiment by developing a layer of ink particles with a desired ink density, such as 20-30% ink solids, and a desired thickness, such as 5-8 microns, upon the surface 43 of the developer member 42 in one illustrative embodiment.

The liquid marking agent used with the development assembly 18 may have a density of solids (e.g., ink particles and charge directors) of approximately 5-8% when introduced into development assembly 18 in example embodiments. The density of the solids of the liquid marking agent may be higher if electrode 48 has a smaller surface 74. More specifically, an increased solids density of the liquid marking agent (e.g., 8%) may be used if surface 74 is smaller (e.g., 4 mm) versus a lower solids density of 5% if surface 74 is larger (e.g., 15 mm) in example embodiments. Furthermore, an increased solids density of the liquid marking agent may also be used for higher process speeds compared with lower process speeds (e.g., process speeds of 1-3 m/s of outer surface 43 of developer member 42 are used to perform imaging operations in one example embodiment).

Developer member 42 may have a diameter of approximately 40-80 mm in one embodiment. In some arrangements, surface 74 of electrode 48 is flat and a relatively large diameter developer member 42 may be used to provide less variation in the gap between surfaces 43, 74 compared with use of developer members 42 having smaller diameters. Put another way, a larger diameter developer member 42 provides less variation in the gap compared with the developer members 42 having smaller diameters for a surface 74 having a constant length. In some arrangements, surface 74 may be curved in correspondence with surface 43 to provide a substantially constant gap. Other embodiments are possible.

Following development of the layer of ink particles upon surface 43 and selective transfer of the ink particles of the layer to imaging member 12 to develop latent images thereon, cleaner roller 52 operates to remove untransferred ink particles from surface 43 of developer member 42. A wiper 54 operates to remove ink particles from cleaner roller 52 and a sponge roller 56 operates to mix the removed ink particles with other liquid marking agent that passes through gap 76. A squeezer roller 58 operates to wring out the sponge roller 56 in the illustrated embodiment.

Referring to FIG. 6, one example method of implementing hard imaging operations is discussed according to one embodiment. Other methods including more, less and/or alternative acts are possible.

At an act A10, the developer member rotates during imaging operations.

At an act A20, a liquid marking agent is provided under pressure to a surface of the developer member in one embodiment.

At an act A30, an electrical field is provided by a development system to cause ink particles of the liquid marking agent to be directed to and adhere to the surface of the developer member to develop a layer of the ink particles upon the surface of the developer member. In one embodiment, an entirety or majority of the development of the layer of ink particles upon the developer member occurs at a gap between an electrode and the developer member. In some embodiments, some additional development of the layer of ink particles upon the developer member occurs at a squeegee.

At an act A40, a squeegee may remove excess carrier fluid from the surface of the developer member.

At an act A50, the developed layer of ink particles upon the surface of the developer member may be used to develop latent images upon an imaging member.

The example embodiments of the developer assemblies described herein may provide some advantages over other assemblies. For example, some of the described embodiments in this disclosure do not need to be as precisely machined and the relative positions of the charging electrode with respect to the developer member are not as critical compared with some other designs.

In addition, some of the development systems of the present disclosure are more compact and occupy less area about the circumference of the developer member compared with the other designs using relatively large static electrodes which allows more open space and more freedom in design and placement of other components about the developer member.

Some additional aspects of the disclosure provide utility compared with some development configurations which use one or more rolling electrodes to generate required electrical fields for development. For example, some rolling electrode designs may utilize relatively high delta voltages with respect to the developer member which may result in print defects by arcing through the ink layer or discharging of the ink layer. In addition, the biasing of the squeegee relative to the developer member may be reduced compared with other designs with the utilization of a back electrode providing at least a majority of the development of the ink layer prior to the ink layer contacting the squeegee according to some embodiments of the disclosure and providing improved print quality.

Furthermore, the flow of liquid marking agent is coupled to gap sizes in some conventional development assemblies since flow of the liquid marking agent is proportional to the size of gaps between biased charging devices and the developer member. In some of the described embodiments of the disclosure, the flow of the liquid marking agent is decoupled from or independent of the size of the gap at the second location of the outer surface of the developer member as discussed above. These example embodiments allow the gaps to be increased (e.g., with the benefit of reduced constraints upon component tolerances) without causing a need for increased flow rates of the liquid marking agent and perhaps reduced presence of air in the liquid marking agent used for development.

The protection sought is not to be limited to the disclosed embodiments, which are given by way of example only, hut instead is to be limited only by the scope of the appended claims.

Further, aspects herein have been presented for guidance in construction and/or operation of illustrative embodiments of the disclosure. Applicant(s) hereof consider these described illustrative embodiments to also include, disclose and describe further inventive aspects in addition to those explicitly disclosed. For example, the additional inventive aspects may include less, more and/or alternative features than those described in the illustrative embodiments. In more specific examples. Applicants consider the disclosure to include, disclose and describe methods which include less, more and/or alternative steps than those methods explicitly disclosed as well as apparatus which includes less, more and/or alternative structure than the explicitly disclosed structure.

The invention claimed is:

1. A liquid marking agent development assembly comprising:

a developer member comprising an outer surface;

a marking agent delivery system to supply a liquid marking agent comprising a plurality of ink particles to a first location of the outer surface of the developer member; and a development system to adhere a plurality of the ink particles to a second location of the outer surface of the developer member, wherein the second location is upstream from the first location with respect to a direction of movement of the outer surface of the developer member, and wherein the development system comprises a squeegee to adhere some of the ink particles to the outer surface at a third location of the outer surface of the developer member which is downstream from the first and second locations of the outer surface with respect to the direction of movement.

2. The assembly of claim 1, wherein the development system comprises an electrode positioned adjacent to the second location and the electrode is to provide an electric field with respect to the developer member to cause the ink particles to adhere to the outer surface of the developer member at the second location.

3. The assembly of claim 2, wherein the electrode is to form a gap with respect to the outer surface of the developer member which is larger than another gap to expel at least some of the liquid marking agent away from the outer surface of the developer member.

4. The assembly of claim 1, wherein the marking agent delivery system is to cause the liquid marking agent to flow adjacent to the outer surface and in a direction against the direction of movement.

5. The assembly of claim 1, wherein the third location is immediately adjacent to the first location of the outer surface of the developer member.

6. The assembly of claim 1, wherein the squeegee is to compact the adhered ink particles and to remove at least some carrier fluid of the liquid marking agent.

7. A hard imaging device comprising:

a development assembly comprising:

a developer member comprising an outer surface to move in a direction;

a marking agent delivery system to provide a liquid marking agent to a first location of the outer surface of the developer member and to cause the liquid marking agent to move in a direction which is against the direction of movement of the outer surface of the developer member; and a development system to form a layer of ink particles of the liquid marking agent upon a second location of the outer surface of the developer member, wherein the development system comprises a squeegee to adhere some of the ink particles to the outer surface at a third location of the outer surface of the developer member which is downstream from the first and second locations of the outer surface with respect to the direction of movement;

an imaging member comprising an outer surface to move with the outer surface of the developer member and to receive some of the ink particles from the layer of ink particles upon the outer surface of the developer member to form a developed image upon the outer surface of the imaging member; and a transfer assembly to transfer the developed image from the outer surface of the imaging member to media to form a hard image.

8. The device of claim 7, wherein the development system comprises an electrode positioned adjacent to the second location of the outer surface of the developer member which is upstream from the first location with respect to the direction of movement of the outer surface of the developer member, and wherein the electrode is to provide an electric field with respect to the developer member to cause the ink particles to adhere to the outer surface of the developer member at the second location.

9. The device of claim 8, wherein the third location is immediately adjacent to the first location of the outer surface of the developer member.

10. The device of claim 7, wherein the marking agent delivery system is to cause the liquid marking agent to flow adjacent to the outer surface of the developer member.

11. A liquid marking agent hard imaging method comprising:

moving an outer surface of a developer member;

providing a liquid marking agent to the outer surface of the developer member at a first location of the outer surface of the developer member;

adhering a plurality of ink particles of the liquid marking agent to the outer surface of the developer member, and wherein the adhering comprises adhering the adhered ink particles at a second location of the outer surface of the developer member which is upstream from the first location of the outer surface with respect to a direction of movement of the outer surface of the developer member; and adhering additional ink particles to the outer surface of the developer member at a third location of the outer surface of the developer member which is downstream from the first location with respect to the direction of movement.

12. The method of claim 11, wherein the adhering comprises adhering using an electrical field with respect to the developer member and which is present at the second location.

13. The method of claim 12, further comprising flowing the liquid marking agent through a gap defined by the outer surface of the developer member and an electrode positioned at the second location and which is configured to provide the electric field.

14. The method of claim 11, further comprising flowing the liquid marking agent adjacent to the outer surface of the developer member from the first location to the second location in a direction against the direction of movement.

15. The method of claim 11, wherein the third location is immediately adjacent to the first location of the outer surface of the developer member.

* * * * *